US008664552B2

(12) United States Patent
Knoerrchen et al.

(10) Patent No.: US 8,664,552 B2
(45) Date of Patent: Mar. 4, 2014

(54) LOCKABLE TURNING HANDLE

(75) Inventors: Oliver Knoerrchen, Cologne (DE); Jan Nowak, Euskirchen (DE); Stephan Stanke, Rheinbach (DE)

(73) Assignee: Eaton Industries GmbH, Bonn (DE)

( * ) Notice: Subject to any disclaimer, the term of this patent is extended or adjusted under 35 U.S.C. 154(b) by 129 days.

(21) Appl. No.: 13/180,712

(22) Filed: Jul. 12, 2011

(65) Prior Publication Data

US 2012/0018286 A1 Jan. 26, 2012

(30) Foreign Application Priority Data

Jul. 23, 2010 (EP) ..... 10170687

(51) Int. Cl.
*H01H 9/28* (2006.01)

(52) U.S. Cl.
USPC ..... 200/43.11

(58) Field of Classification Search
USPC ..... 200/179, 19.01, 19.07, 19.18, 19.19, 200/19.22, 43.11, 43.12, 43.15, 43.19, 293, 200/327, 334
See application file for complete search history.

(56) References Cited

U.S. PATENT DOCUMENTS 5,609,244 A * 3/1997 Reiter ..... 200/43.11
5,998,743 A 12/1999 Unkel
6,423,912 B1 * 7/2002 Arenz et al. ..... 200/43.08
7,227,092 B2 * 6/2007 Low et al. ..... 200/43.14
2006/0278505 A1 12/2006 Low et al.

FOREIGN PATENT DOCUMENTS

| | | | |
|---|---|---|---|
| CH | 631828 | A5 | 8/1982 |
| DE | 12 00 923 | B | 9/1965 |
| DE | 42 06 378 | A1 | 9/1993 |
| DE | 43 21 981 | A1 | 1/1995 |
| DE | 196 03 238 | C1 | 4/1997 |
| DE | 199 39 717 | A1 | 2/2001 |

OTHER PUBLICATIONS

European Search Report for EP 10 17 0687, dated Dec. 14, 2010.
HPL 2010 Catalog, Eaton Industries, 2010, p. 4/48.

* cited by examiner

*Primary Examiner* — Edwin A. Leon
*Assistant Examiner* — Anthony R. Jimenez
(74) *Attorney, Agent, or Firm* — Leydig, Voit & Mayer, Ltd.

(57) ABSTRACT

An interlockable lock-out handle system for an electrical switching device includes a lock-out rim and a lock-out handle. The lock-out rim is configured to be disposed over an operating shaft of the switching device and fastened to at least one of switch housing and a front plate. The lock-out handle is configured to be fastened by a clamping device in rotational engagement on the operating shaft. The lock-out handle includes a rotary handle having a grippable lateral surface and a lock-out collar. The lock-out collar is vertically displaceable relative to the rotary handle in a direction of a longitudinal axis of the operating shaft into a CLOSED position and an OPEN position. The lock-out collar is engaged with the lock-out rim so as to prevent twisting movement of the lock-out collar relative to the lock-out rim when the lock-out collar is in the CLOSED position.

16 Claims, 3 Drawing Sheets

LOCKABLE TURNING HANDLE

CROSS REFERENCE TO RELATED APPLICATIONS

This application claims priority to European Patent Application No. EP 10 170 687.7 filed on Jul. 23, 2010.

FIELD

The invention relates to an interlockable lock-out handle system for an electrical switching device.

BACKGROUND

Various specifications, such as IEC 60947-1 and DIN EN 60204-1, require electrical switching devices in specific installation situations to be capable, in the OFF position of the switching device, of being safeguarded against being switched on again by means of one or more padlocks in order for example to prevent an electrical installation from being switched on again while maintenance work is being carried out on the installation. There are requirements that the OFF position be safeguarded by means of up to 4 padlocks.

CH 631 828 A5 describes an interlockable lock-out handle system. A base plate, which is mountable onto an operating shaft of a rotary switch and is fastenable to the rotary switch or a device front plate from the front, contains a lock-out disk that is mountable in rotational engagement onto the operating shaft and has at least one recess, a strip-shaped locking bar that is displaceable laterally for engagement in the recess of the lock-out disk, and a slide that is moulded vertically onto the locking bar and extends parallel to the bottom edge of the base plate. The slide at one end projects laterally from the base plate and is acted on at the other end by a compression spring. A cover that is mountable onto the base plate covers the base plate and the slide. The slide and the part of the cover that surrounds the slide are provided with holes, which correspond in the pressed state of the slide and into which at least one padlock or bracket lock is insertable for interlocking the rotary switch. In this interlocked state the cover cannot be removed, so that a release of the interlock is not possible. The drawbacks are the overall size, which is unsatisfactory due to the closing apparatus being separate from the rotary handle, and the number of components.

DE 42 06 378 A1 describes an interlockable lock-out handle system which forms, with an operating shaft of a switching device, a positive connection in the direction of rotation and is snap-mounted in the axial direction positively or non-positively on the operating shaft, and which comprises as a closing apparatus a swivel lever, which in the swivelled position blocks both the rotational movement of the rotary handle and the removal from the operating shaft. Closing- or lead-sealing apparatuses may be inserted into bores of the swivel lever as protection against unauthorised operation. The drawback of this solution is that the operating shaft end has to be matched very precisely to the lug of the swivel lever, this being impossible to carry out in the case of differing clearances of the switch from the front plate or in the case of differing front plate thicknesses.

DE-AS 12 00 923 describes a closable actuating apparatus comprising a rotary handle that is fastened by means of a locking pin on the operating shaft of a rotary switch. Pivotably mounted in the rotary handle is a lock-out lever in a bearing block, which is held in a cut-out of the rotary handle and in which there is mounted in an axially movable manner a lock-out pin, which is coupled non-positively to the lock-out lever and engages in a corresponding cut-out of the rotary switch housing. The lock-out lever is movable in an open groove, facing away from the rotary switch of the rotary handle, and is provided with an oblong hole for receiving padlocks. In the rest position the lock-out lever has a working surface that projects slightly from the lateral surface of the rotary handle. A helical spring that is supported on the one hand against a base plate of the bearing block and on the other hand against a dog of the lock-out bolt holds the lock-out lever in the rest position thereof. A transverse pin connects the lock-out bolt via an oblong hole to the lock-out lever. The drawbacks are that fastening the rotary handle on the operating shaft is a laborious process requiring precise measurement and that there is no possibility of carrying out modifications with regard to the closing positions.

DE 43 21 981 C2 describes a closable actuating device for a rotary switch comprising a cover, which is latched onto the front of the rotary switch and through which the operating shaft of the rotary switch extends, comprising a rotary handle, which is fastened in rotational engagement on the operating shaft and seated in front of the cover and has a closing aperture for a padlock that is to be fitted, and comprising an externally actuable lock-out slide that is mounted so as to be displaceable at right angles to the operating shaft axis in the rotary handle in order to block and/or clear the closing aperture. The cover is held together with the rotary handle and the lock-out slide by means of a retaining ring to form an assembly group that is mountable onto the rotary switch. The lock-out slide, which is provided with an actuating extension, is substantially rectangular and has on its side facing the rotary switch a groove, which in the lock-out position of the rotary handle moves out of coincidence with a guide collar of the cover, instead of which however a shoulder situated alongside the groove positions itself in a blocking manner against a gap of the guide collar. The drawback of this solution is that it is always fixed with regard to the positions of its closable operating position and does not allow any additional closing positions.

Finally, DE 196 03 238 C1 describes a closable actuating apparatus for a rotary table in which a lock-out slide serving as a closing apparatus is used to actuate a lock-out bolt, which in turn comes into lock-out operation with a rotationally engaged lock-out disk. The rotary handle that is tightly non-positively clamped on the operating shaft is incorporated into the lock-out bolt. By selecting the number and the angular position of the cut-outs in the lock-out disk that are provided for the lock-out bolt, the number and angular position of the closable operating positions of the rotary switch may be defined. In the handle part of the rotary handle a closing through-opening is provided for fitting padlocks. The drawback of this solution is that, because there is only limited space available in the handle part, only fewer than 4 padlocks may be fitted.

The company Eaton Industries, in its catalogue HPL 2010, offers a rotary handle with lock-out rim SVB, wherein the rotary handle may be safeguarded via the lock-out rim against unauthorised switching-on by means of up to three padlocks. In order to meet the requirement for a fourth lock, a fourth hole in the rotary handle and rim is conceivable but then there would also be a closing facility in positions that are not permitted in the standards. For example, in the case of contacts welded in the ON position in the basic unit, the handle could be rotated far enough in the OFF direction to enable a lock to be fitted and give the impression of a safe OFF position.

SUMMARY

In an embodiment, the present invention provides an interlockable lock-out handle system for an electrical switching device including a lock-out rim and a lock-out handle. The lock-out rim is configured to be disposed over an operating shaft of the switching device and fastened to at least one of a switch housing and a front plate. The lock-out handle is configured to be fastened by a clamping device in rotational engagement on the operating shaft. The lock-out handle includes a rotary handle having a grippable lateral surface and a lock-out collar. The lock-out collar is vertically displaceable relative to the rotary handle in a direction of a longitudinal axis of the operating shaft into a CLOSED position and an OPEN position. The lock-out collar is engaged with the lock-out rim so as to prevent twisting movement of the lock-out collar relative to the lock-out rim when the lock-out collar is in the CLOSED position.

BRIEF DESCRIPTION OF THE DRAWINGS

Exemplary embodiments of the present invention are described in more detail below with reference to the drawings, in which.

DETAILED DESCRIPTION

Figure 1:
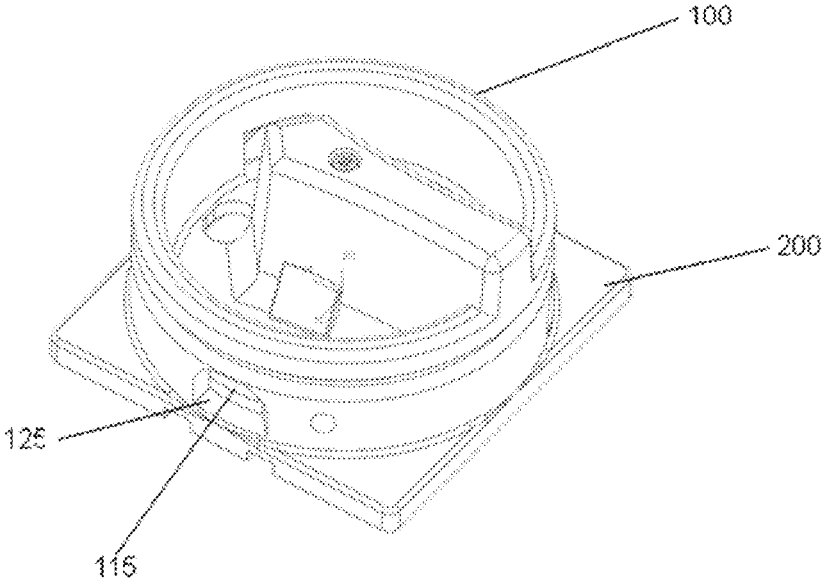
FIG. 1 shows an interlockable lock-out handle system according to the prior art

In an embodiment, the present invention provides an interlockable lock-out handle system for an electrical switching device that may be safeguarded against unauthorised switching-on in a safe OFF position of the switching device by means of at least four padlocks or bracket locks.

The interlockable lock-out handle system according to an embodiment of the invention comprises a lock-out handle that is slipped onto the operating shaft of the electrical switching device and is divided into the two components, rotary handle and lock-out collar. In this case, the lock-out collar is vertically displaceable relative to the rotary handle in the direction of the operating shaft longitudinal axis into a CLOSED and an OPEN position, wherein the lock-out collar is in engagement with the lock-out rim in such a way that in the closed position it is not twistable relative to the lock-out rim.

In an embodiment, the present invention also provides an electrical switching device that may be safeguarded against unauthorised switching-on in a safe OFF position by means of at least four padlocks or bracket locks.

Electrical switching devices according to embodiments of the invention include an interlockable lock-out handle system according to embodiments of the invention.

According to the an embodiment of the invention the lock-out rim comprises at least one guide groove on its inner peripheral surface. The lock-out collar, on the other hand, has at least one corresponding guide rail on its outer peripheral surface. The guide groove is developed in such a way that the lock-out rim may be displaced vertically in the direction of the longitudinal axis of the operating shaft into a CLOSED position only when the operating shaft is in the OFF position. In this CLOSED position the lock-out rim and hence the lock-out handle are connected in rotational engagement to the lock-out rim so that in this position it is unable to twist the operating shaft and hence switch the switch on.

The lock-out collar can have in its peripheral side at least one opening, through which the shackle of a padlock may be passed when the lock-out collar is in the CLOSED position. Thus, it is impossible to shift the lock-out collar into the open position without removing the shackle of the lock.

In a preferred embodiment the shackles of at least 4 padlocks may be passed through the at least one opening in the peripheral side of the lock-out collar.

In an advantageous embodiment the interlockable lock-out handle system comprises at least two guide grooves and guide rails over the periphery of the lock-out rim and the lock-out collar. The lock-out rim may therefore be guided symmetrically.

In an embodiment, the present invention provides an advantage in that the lock-out handle, preventing the rotational movement of the lock-out handle, and hence preventing the electrical switching device from being switched on, is functionally separate from the closing facility. The rotational movement is prevented by the engagement of the guide rail of the lock-out collar in the guide groove of the lock-out rim. The closing facility, on the other hand, is effected by preventing a vertical movement of the lock-out rim out of the CLOSED position. In this case, by virtue of a suitable dimensioning of the fit between guide rail and guide groove it is possible to prevent the lock-out handle in the CLOSED position from being rotated to such an extent that the switch is no longer in a safe OFF state and/or, in the case for example of welded switching contacts of the electrical switching device, to prevent the lock-out handle from being rotated into a position that, without the contacts being welded, would correspond to a safe OFF position of the electrical switching device. It is to be regarded as a further advantage that the lock-out collar, which in the CLOSED position of the interlockable lock-out handle is pulled in the axial direction out of the lock-out rim, partially covers the grippable lateral surface of the rotary handle, so that in this CLOSED position of the rotary handle an operator will find less surface area to apply his hand or a tool than in the OPEN position. As a result, in this position less torque may be applied to the rotary handle than in the OPEN position. Thus, in the closed state of the rotary handle an unauthorised switching-on of the electrical switching device by the use of force is made more difficult.

The conventional interlockable lock-out handle system (100) shown in FIG. 1 is of an integral construction. The closing facility is provided by means of pairs of openings in the peripheral sides of the lock-out rim (130) and the lock-out handle. If the lock-out handle (100) is in a position that corresponds to the OFF position of the electrical switching device, then the openings (115) of the pairs of openings in the peripheral sides of the lock-out rim (130) and the lock-out handle (100) coincide, thereby allowing the shackle of a padlock to be passed through both openings (115, 125) of a pair of openings. In this case, there has to be a pair of openings for each padlock provided, wherein the dimensions of the openings (115, 125) have to be matched to the diameter of the shackle of the padlock. If the diameters of the openings (115, 125) are too large compared to the diameters of the shackles of the padlocks, the rotary handle (110) may possibly be rotated to such an extent that there is no longer a safe isolating distance between the switching contacts of the electrical switching device. The situation in which the switching contacts of the electrical switching device are welded to one another is also conceivable. In this situation the rotary handle (100) along with the lock-out collar (120) should not be allowed to rotate far enough for the openings (115, 125) of the pairs of openings to coincide to such an extent that a padlock may be fitted. As the periphery of the lock-out handle (100)

and/or the lock-out rim (130) is limited as a function of the respective overall size of the switch, the number of openings (115, 125) is likewise limited if the previously mentioned conditions are to be observed.

Figure 2:
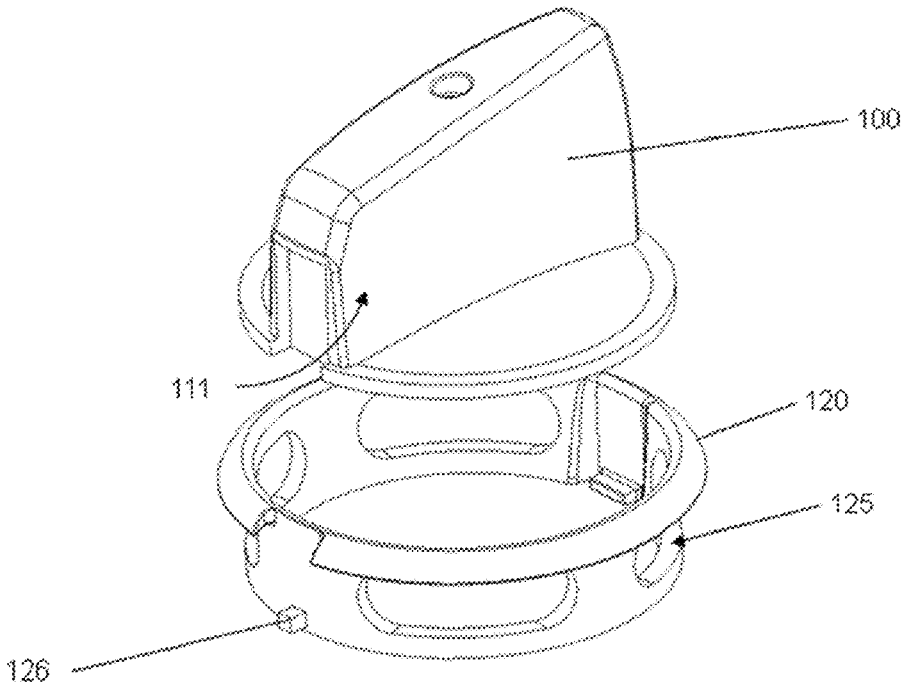
FIG. 2 is an exploded view of the two components, a rotary handle and a lock-out collar, of an interlockable lock-out handle system.

FIG. 2 shows the components, lock-out collar (120) and rotary handle (110), of an interlockable lock-out handle system according to an embodiment of the invention. The openings (115, 125) for the shackles of padlocks may be seen. It is evident that these openings (115, 125) need not be matched in the peripheral direction to the diameters of the padlock shackles in such a way as to allow only a very limited play between padlock shackle and opening (115, 125). On the contrary, in FIG. 2 oblong holes as the opening (115, 125) may be seen. The shackles of the padlocks need merely prevent the vertical movement of the lock-out collar (120) relative to the lock-out rim (130) (see also the following figures). FIG. 2 further shows on the lock-out collar (120) the guide rail (126) that interacts with the guide groove (136) of the lock-out rim (see also the following figures).

Figure 3:
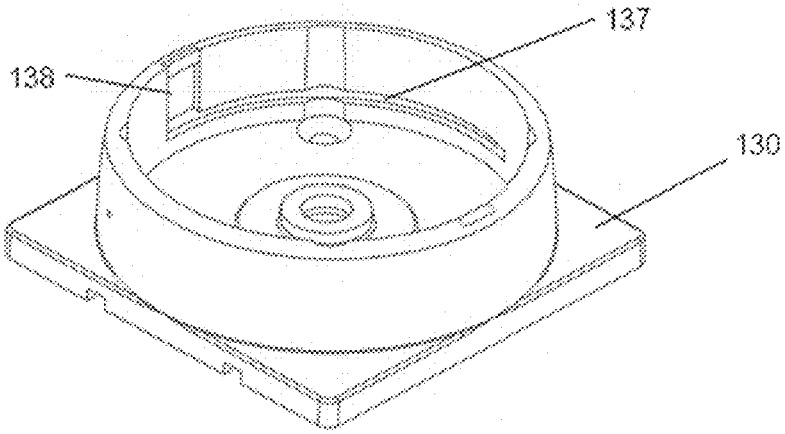
FIG. 3 shows a lock-out rim.

FIG. 3 shows a lock-out rim (130) according to an embodiment of the invention with the guide groove (136). This guide groove (136) consists of a first part (137) with a main extent in the peripheral direction and a second part (138) with a main extent direction substantially at right angles to the peripheral direction. The first part (137) of the guide groove (136) extends in the peripheral direction at least over part of the inner peripheral surface of the lock-out rim (130). The second part (138) of the guide groove (136) is situated at one end of the first part (137) of the guide groove (136) at the point of the periphery that corresponds to the position of the guide rail (126) on the lock-out collar (120) when the electrical switching device is in the OFF state.

Figure 4:
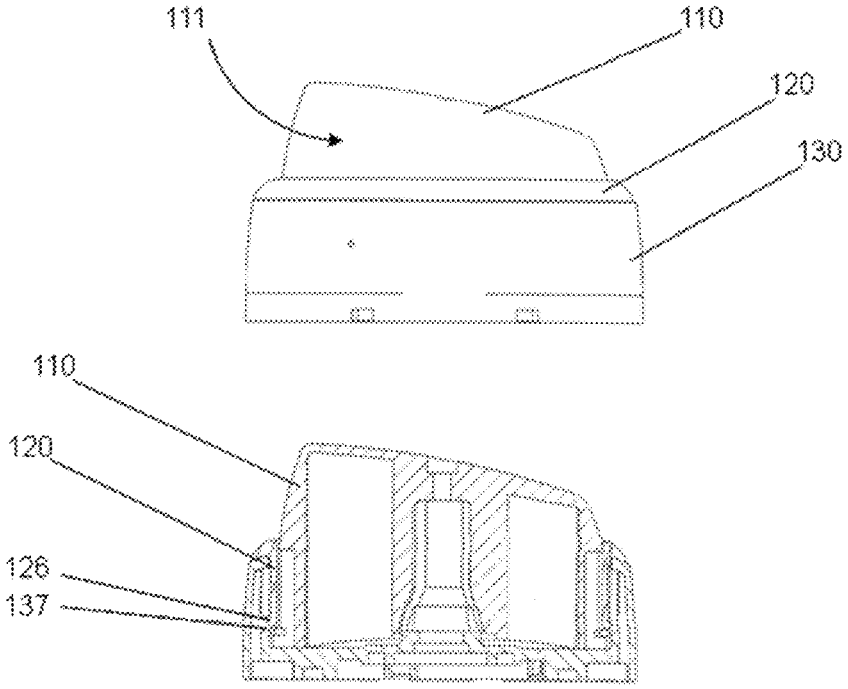
FIG. 4 shows a rotary handle mounted into a lock-out rim in an OPEN position in a side view and in section.

FIG. 4 shows the components according to an embodiment of the invention, rotary handle (110), lock-out collar (120) and lock-out rim (130), mounted in the OPEN position in side view and in section. The lock-out collar (120) is pressed into the lock-out rim (130). The guide rail (126) is situated in the first part (137) of the guide groove (136), the rotary handle (110) together with the lock-out collar (120) could be twisted relative to the lock-out rim (130) to the extent allowed by the first part (137) of the guide groove (136) and hence could operate the electrical switching device.

Figure 5:
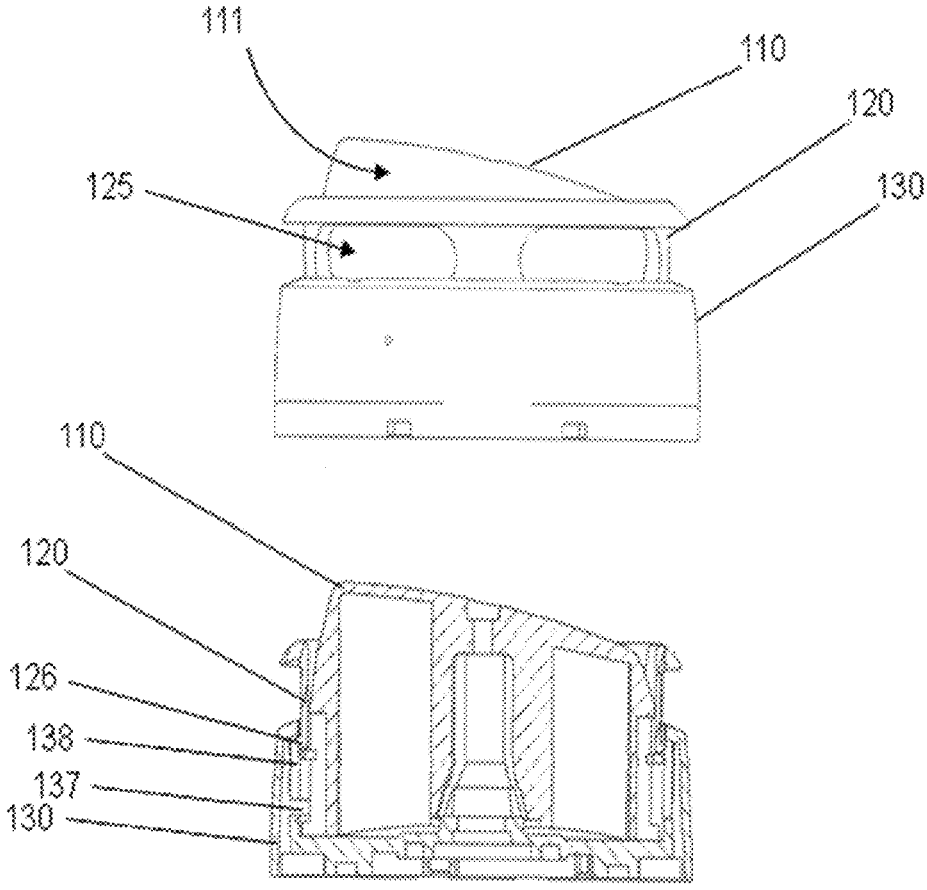
FIG. 5 shows a rotary handle mounted into a lock-out rim in a CLOSED position in a side view and in section.

FIG. 5 shows the components according to the invention, rotary handle (110), lock-out collar (120) and lock-out rim (130), mounted in the CLOSED position in side view and in section. The guide rail (126) is situated in the second part (138) of the guide groove (136). The lock-out collar (120) is pulled in the axial direction as far out of the lock-out rim (130) as the second part (138) of the guide groove (136) allows. In this position the lock-out collar (120) with the rotary handle (110) cannot be twisted relative to the lock-out rim (130). Over the periphery of the lock-out collar (120) openings (125) in the form of oblong holes may be seen. Shackles of padlocks, which prevent the lock-out collar (120) from being pressed back into the lock-out rim (130), can be passed through these openings (125). The lock-out handle (100) is immobilised; the electrical switching device cannot be switched on. As a result of the lock-out collar (120) being pulled in the axial direction out of the lock-out rim (130), the grippable lateral surface (111) of the rotary handle (110) is partially covered, so that in this CLOSED position of the rotary handle (110) an operator will find less surface area to apply his hand or a tool than in the OPEN position. Thus, in this position less torque may be applied to the rotary handle (110) than in the OPEN position. An unauthorised switching-on of the electrical switching device in the closed state of the lock-out handle (100) by the use of force is therefore made more difficult.

While the invention has been particularly shown and described with reference to preferred embodiments thereof, it will be understood by those skilled in the art that various changes in form and details may be made therein without departing from the spirit and scope of the invention.

LIST OF REFERENCE NUMERALS

10 interlockable lock-out handle system
100 lock-out handle
110 rotary handle
111 grippable lateral surface
115 opening
120 lock-out collar
125 opening
126 guide rail
130 lock-out rim
136 guide groove
137 first park of guide groove
138 second park of guide groove

What is claimed is:

1. An interlockable lock-out handle system for an electrical switching device comprising:

a lock-out rim configured to be disposed over an operating shaft of the switching device and fastened to at least one of a switch housing and a front plate; and a lock-out handle configured to be fastened by a clamping device in rotational engagement on the operating shaft, the lock-out handle including:

a rotary handle having a grippable lateral surface, and a lock-out collar, the lock-out collar being vertically displaceable relative to the rotary handle in a direction of a longitudinal axis of the operating shaft into a CLOSED position and an OPEN position, and the lock-out collar being engaged with the lock-out rim so as to prevent twisting movement of the lock-out collar relative to the lock-out rim when the lock-out collar is in the CLOSED position, wherein the lock-out rim is configured to be vertically displaceable only when the electrical switching device is in an OFF position.

2. The interlockable lock-out handle system recited in claim 1, wherein the rotary handle is fixed to the lock-out collar so as to prevent non-destructive detachment of the rotary handle from the lock-out collar.

3. The interlockable lock-out handle system recited in claim 1, wherein an engagement of the lock-out collar in the lock-out rim includes a guide groove on an inner peripheral surface of the lock-out rim and a corresponding guide rail on the lock-out collar that engages the guide groove.

4. The interlockable lock-out handle system recited in claim 3, wherein the engagement includes a second guide groove on the peripheral surface of the lock-out rim and a second corresponding guide rail on the lock-out collar.

5. The interlockable lock-out handle system recited in claim 1, wherein the lock-out collar includes a peripheral side having at least one opening extending therethrough, the at least one opening being configured to receive a shackle of a padlock when the lock-out collar is in the CLOSED position so as to prevent shifting of the lock-out collar into the OPEN position without removal of the shackle of the lock.

6. The interlockable lock-out handle system recited in claim 5, wherein the at-least one opening in the peripheral side of the lock-out collar is configured to accommodate at least four shackles of padlocks.

7. The interlockable lock-out handle system recited in claim 1, wherein the lock-out collar reduces a size of an accessible portion of the grippable lateral surface of the rotary handle when in the CLOSED position compared to the OPEN position.

8. An electrical switching device comprising:

an operating shaft;

at least one of a switch housing and a front plate; and an interlockable lock-out handle system including:

a lock-out rim configured to be disposed over the operating shaft and fastened to the at least one of a switch housing and a front plate, and a lock-out handle fastened in rotational engagement on the operating shaft by a clamping device, the lock-out handle including a rotary handle having a grippable lateral surface, and a lock-out collar, the lock-out collar being vertically displaceable relative to the rotary handle in a direction of a longitudinal axis of the operating shaft into a CLOSED position and an OPEN position, and the lock-out collar being engaged with the lock-out rim so as to prevent twisting movement of the lock-out collar relative to the lock-out rim when the lock-out collar is in the CLOSED position, wherein the lock-out rim is vertically displaceable only when the electrical switching device is in an OFF position.

9. The electrical switching device recited in claim 8, wherein the rotary handle is fixed to the lock-out collar so as to prevent non-destructive detachment of the rotary handle from the lock-out collar.

10. The electrical switching device recited in claim 8, wherein an engagement of the lock-out collar in the lock-out rim includes a guide groove on an inner peripheral surface of the lock-out rim and a corresponding guide rail on the lock-out collar that engages the guide groove.

11. The electrical switching device recited in claim 10, wherein the engagement includes a second guide groove on the peripheral surface of the lock-out rim and a second corresponding guide rail on the lock-out collar.

12. The electrical switching device recited in claim 8, wherein the lock-out collar includes a peripheral side having at least one opening extending therethrough, the at least one opening being configured to receive a shackle of a padlock when the lock-out collar is in the CLOSED position so as to prevent shifting of the lock-out collar into the OPEN position without removal of the shackle of the lock.

13. The electrical switching device recited in claim 12, wherein the at-least one opening in the peripheral side of the lock-out collar is configured to accommodate at least four shackles of padlocks.

14. The electrical switching device recited in claim 8, wherein the lock-out collar reduces a size of an accessible portion of the grippable lateral surface of the rotary handle when in the CLOSED position compared to the OPEN position.

15. An interlockable lock-out handle system for an electrical switching device comprising:

a lock-out rim configured to be disposed over an operating shaft of the switching device and fastened to at least one of a switch housing and a front plate; and a lock-out handle configured to be fastened by a clamping device in rotational engagement on the operating shaft, the lock-out handle including:

a rotary handle having a grippable lateral surface, and a lock-out collar, the lock-out collar being vertically displaceable relative to the rotary handle in a direction of a longitudinal axis of the operating shaft into a CLOSED position and an OPEN position, and the lock-out collar being engaged with the lock-out rim so as to prevent twisting movement of the lock-out collar relative to the lock-out rim when the lock-out collar is in the CLOSED position, wherein the lock-out collar reduces a size of an accessible portion of the grippable lateral surface of the rotary handle when in the CLOSED position compared to the OPEN position.

16. An electrical switching device comprising:

an operating shaft;

at least one of a switch housing and a front plate; and an interlockable lock-out handle system including:

a lock-out rim configured to be disposed over the operating shaft and fastened to the at least one of a switch housing and a front plate, and a lock-out handle fastened in rotational engagement on the operating shaft by a clamping device, the lock-out handle including a rotary handle having a grippable lateral surface, and a lock-out collar, the lock-out collar being vertically displaceable relative to the rotary handle in a direction of a longitudinal axis of the operating shaft into a CLOSED position and an OPEN position, and the lock-out collar being engaged with the lock-out rim so as to prevent twisting movement of the lock-out collar relative to the lock-out rim when the lock-out collar is in the CLOSED position, wherein the lock-out collar reduces a size of an accessible portion of the grippable lateral surface of the rotary handle when in the CLOSED position compared to the OPEN position.

* * * * *